United States Patent [19]

Montgomery

[11] Patent Number: 4,537,210

[45] Date of Patent: Aug. 27, 1985

[54] SHELTER

[76] Inventor: Rodney L. Montgomery, 4 Kellaway St., Darwin, Australia

[21] Appl. No.: 448,902

[22] PCT Filed: Apr. 5, 1982

[86] PCT No.: PCT/AU82/00048

§ 371 Date: Dec. 6, 1982

§ 102(e) Date: Dec. 6, 1982

[87] PCT Pub. No.: WO82/03317

PCT Pub. Date: Oct. 14, 1982

[30] Foreign Application Priority Data

Apr. 6, 1981 [AU] Australia ..... PE8327

[51] Int. Cl.[3] ..... A45F 1/00; E04B 1/347

[52] U.S. Cl. ..... 135/87; 135/115

[58] Field of Search ..... 135/99, 119, DIG. 1, 135/87, 115, 900

[56] References Cited

U.S. PATENT DOCUMENTS

| | | | |
|---|---|---|---|
| 1,449,689 | 3/1923 | Muehleisen et al. | 135/99 |
| 2,051,643 | 8/1936 | Morrison | 135/119 |
| 2,251,624 | 8/1941 | Foree et al. | 135/115 |
| 2,497,596 | 2/1950 | Frieder et al. | 135/115 |
| 2,848,233 | 8/1958 | Wynn | 135/115 |
| 3,060,949 | 10/1962 | Moss . | |
| 3,202,193 | 8/1965 | Ware | 135/115 |
| 4,075,723 | 2/1978 | Bareis et al. | 135/DIG. 1 |

FOREIGN PATENT DOCUMENTS

| | | |
|---|---|---|
| 637114 | 10/1950 | United Kingdom . |
| 1018978 | 2/1966 | United Kingdom : |

*Primary Examiner*—Richard J. Apley
*Assistant Examiner*—S. R. Crow
*Attorney, Agent, or Firm*—Larson and Taylor

[57] ABSTRACT

A shelter includes a substantially rectangular fabric cover consisting mainly of square or rectangular corner sections (10, 21, 31) of a fabric which is unstable on the bias, the cover being supported, at the innermost corners of the corner sections, by one or more posts (15, 24) or ribs (37), and the outermost corners of the corner sections are attached to tensioning means (17, 28, 37) so as to stretch the corner sections (10, 21, 31) on the bias in downward and outward directions.

3 Claims, 6 Drawing Figures

Fig. 1.
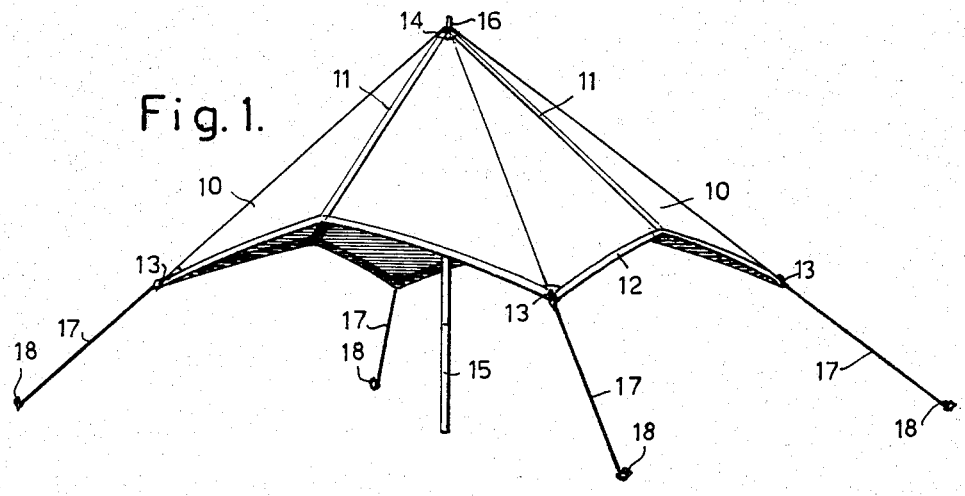
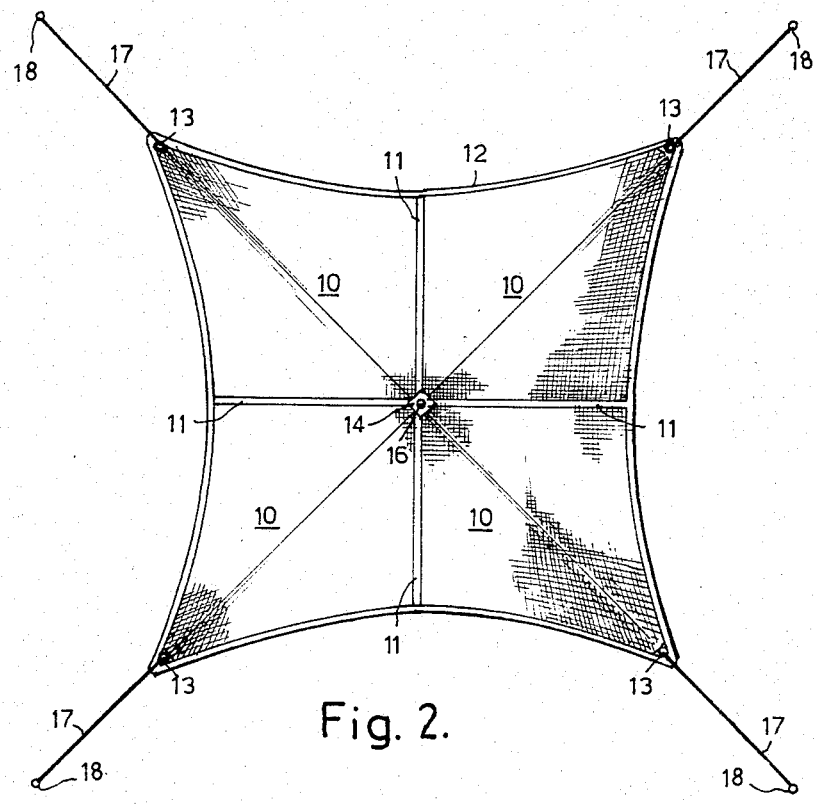
Fig. 2.

Fig. 3.
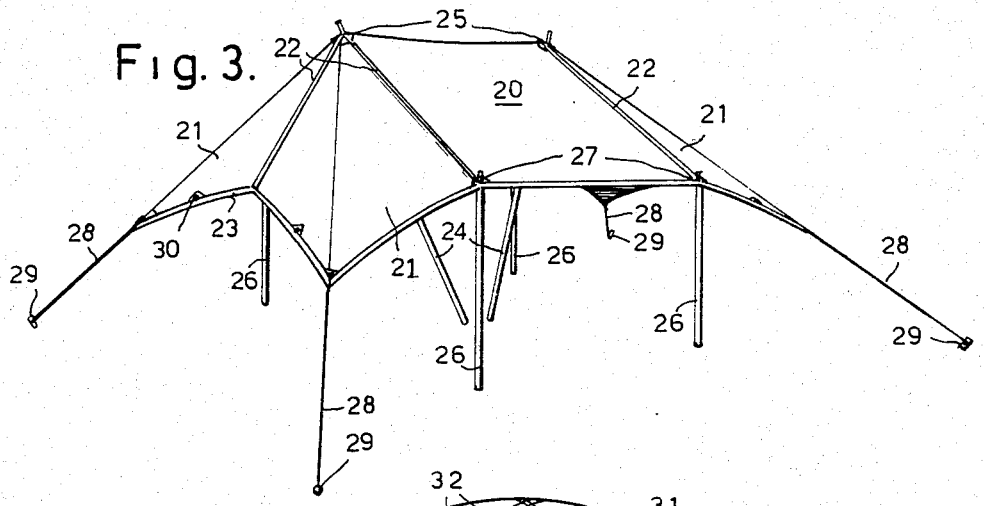
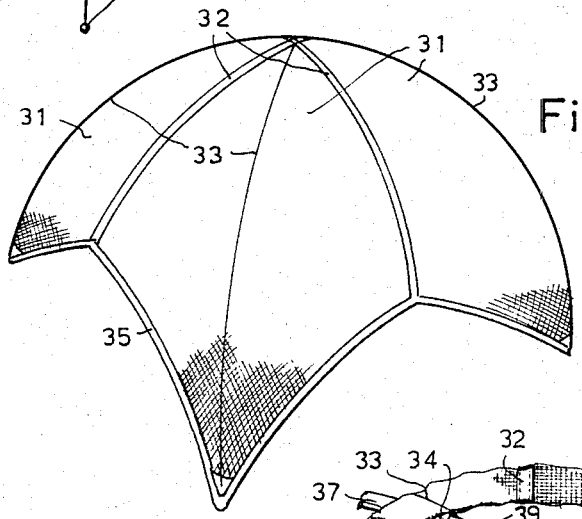
Fig. 4.
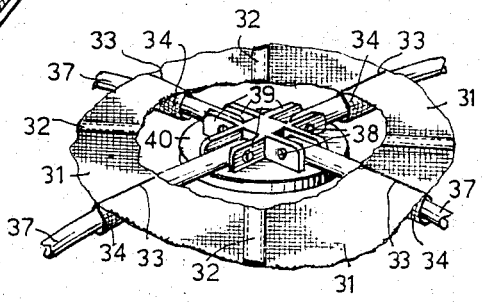
Fig. 5.
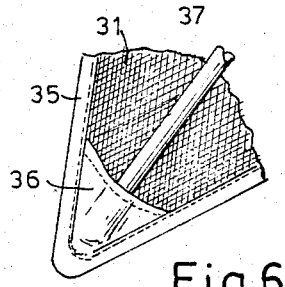
Fig. 6.

SHELTER

BACKGROUND OF THE INVENTION

This invention relates to an improved shelter.

BRIEF SUMMARY OF THE INVENTION

The general object of the invention is to provide a shelter such as a shade to give protection from the sun's heat, or a shelter of the nature of a tent, the shelter being particularly simple and economical to manufacture and capable of being quickly and easily erected, or taken down and folded for transport or storage.

Woven fabrics under load behave in different ways depending on their inherent characteristics, and they may be grouped as being either stable or unstable on the bias. Those fabrics which are unstable on the bias are capable of being readily stretched or extended in a direction diagonal with respect to the weave of the fabric, those that are stable on the bias resisting such stretching or extension.

The present invention resides broadly in a shelter including a cover having substantially rectangular corner sections of fabric which is unstable on the bias, means for supporting the cover at the innermost corners of the corner sections, tensioning means, and means for attaching the tensioning means to the outermost corners of the corner sections to stretch such corner sections on the bias in a downward direction relative to the point or points at which the shelter cover is supported.

BRIEF DESCRIPTION OF THE SEVERAL VIEWS OF THE DRAWINGS

In order that preferred embodiments of the invention may be readily understood and carried into practical effect, reference is now made to the accompanying drawings wherein:

FIG. 1 is a perspective view of a shelter according to the invention and erected for use, FIG. 2 is a plan view of the shelter shown in FIG. 1, FIG. 3 is a perspective view of a shelter according to another embodiment of the invention, FIG. 4 is a perspective view of a further embodiment of the invention, FIG. 5 is a broken-away perspective detail drawing showing the central part of the shelter shown in FIG. 4, and FIG. 6 is a perspective detail drawing showing, from inside, a corner of the shelter illustrated in FIGS. 4 and 5.

DETAILED DESCRIPTION OF THE PREFERRED EMBODIMENTS

Referring initially to FIGS. 1 and 2 of the drawings, a shelter cover is made of four equal square sections 10, cut from a fabric which is unstable on the bias. The shelter may be for affording shade protection, the fabric employed being of the open-wave type commonly known as "shade cloth", woven of flat filaments of a plastics material. The four square sections, which constitute corner sections, are sewn together to form the four corners of a square cover the joins being reinforced by narrow strips 11 of non-stretching material sewn in place. The fabric cover is bordered by an edging 12 of any suitable flexible material which is resistant to stretching, such as a plasticised fabric which is stable on the bias. A grommet with an eye, indicated at 13, is provided at each of the four corners of the shelter cover, and a central reinforced grommet and eye 14 is provided in the cover at the junction of the four fabric corner sections 10.

The shelter cover is supported by a primary support pole 15, which may consist of coaxially interfitted metal tubular sections of which the uppermost has a reduced-diameter upwardly extending pin 16 engaging closely in the central eye 14 of the shelter. Guy ropes 17 are secured to the four corner eyes at 12 and are tensioned and made fast to pegs 18 driven into the ground.

The tension of the guy ropes 17 on the corner sections 10, which are unstable on the bias, results in these four corner sections being stretched or extended diagonally so that the shelter cover which originally was of flat square shape assumes a somewhat pyramidal shape.

Instead of using a primary support pole 15, the shelter cover may be centrally suspended by a rope from a tree branch or overhead structure.

In the embodiment of the invention shown in FIG. 3, the shelter cover includes a rectangular central transverse section 20 of a fabric or other pliable material which is stable on the bias, and to each end of this central section there are secured two adjacent square corner sections 21 substantially similar to the corner sections 10 before described with reference of FIGS. 1 and 1, being made of a material which is unstable on the bias, the joins being reinforced by non-stretching strips 22 and the whole shelter sheet having an edging 23 of pliable non-stretching material. This shelter cover is supported by two primary support poles 24 engaged with eyes in two reinforced grommets 25, each at a junction of one pair of corner sections 21 and the central section 20, and by secondary support poles 26 engaged with eyes in reinforced grommets 27 at the corners of the central transverse section 20. Guy ropes 28 secured to grommets and eyes at the four corners of the cover are tensioned and fixed to pegs 29 driven into the ground so that the corner sections 21 of the shelter cover are stretched on the bias. Additional grommets with eyes are provided, as indicated at 30, for alternate methods of erection, for example with additional secondary support poles or guy ropes.

The covers of shelters according to either of the illustrated embodiments of the invention, when taken down, may be quickly restored to their square or rectangular shape, and easily folded, for transport or storage. The shelters may be manufactured very simply and economically, without the expense of cutting the fabric to other than very simple shapes, with little, if any, wastage of material, and without the seaming ordinarily required.

In the embodiment of the invention shown in FIGS. 4, 5 and 6, the shelter cover consists primarily of four equal square sections 31 of material, which is unstable on the bias, sewn together and reinforced at the joins by flexible strips 32, as before described. Along its diagonal lines 33 the shelter cover is folded over and a line of zig-zag stitching is sewn along each folded-over part a fairly short distance from the fold to form a tubular sleeve 34. The four radiating sleeves 34 are cut away at and near to their outer ends, at the corners of the cover. An edging strip 35 of flexible non-stretching material is sewn about the periphery of the shelter cover and, at the underside of each corner of the cover there is formed a pocket 36.

Four resiliently flexible rods 37, which may suitably be of fibreglass, are hingedly interconnected, each of the rods having an end pivoted by a pin 38 between a pair of parallel flanges 39 extending upwardly from a stop disc 40, the parts being so made and arranged that the four rods 37 may be raised hingedly to lie close to each other, perpendicular to the stop disc 40, or may be hingedly lowered so that, as shown in FIG. 5, their inner end portions lie upon the stop disc, radiating in equally spaced relationship.

The rods 37 are passed through the sleeves 34 and, by bringing the rods close to each other, the shelter may be folded, the cover being inside-out, and about or close to the rods. In this compact form the shelter may be easily stored in a tubular container (not shown) for storage.

To erect the shelter, the four rods 37 are brought hingedly down so that their inner end portions, with their axes substantially co-planar, rest on the stop disc 40. The outer ends of the rods are then inserted in the pockets 36 at the corners of the shelter cover, the rods being of such length that to do this, the shelter cover must be considerably stretched along its diagonals. The periphery of the shelter cover being non-stretchable, the shelter is thus caused to assume a more or less umbrella-shaped or domed form, as shown in FIG. 4, without supporting pole, guy ropes or pegs being required. The shelter may be entered by raising part of it, or one or more or its corners may be raised and supported in any suitable way.

Fabrics other than shade cloth, and which are sufficiently unstable on the bias and, at the same time, have adequate waterproofing qualities, may be used for the corner sections of shelter covers according to the invention, so that the shelters may give protection from rain as well as from the sun. Provision may be made for the attachment of side wall sections to the shelters. These, and many other modifications of constructional detail and design, which will be readily apparent to persons skilled in the art, are considered to lie within the scope and ambit of the invention herein described.

I claim:

1. A shelter including:

a cover having substantially rectangular corner sections of fabric which is unstable on the bias, means for supporting the cover at the innermost corners of the corner sections, tensioning means, attachment means for attaching the tensioning means to the outermost corners of the corner sections to stretch such corner sections on the bias in a downward direction relative to the point or points at which the shelter cover is supported, a reinforced eye in said corner opposite said stretched corner sections, a central support pole for supporting the inner corners of the rectangular sections, said pole having means at the top which engages closely in said eye; and adjacent sections of the cover being joined along lines reinforced by strips of flexible material resistant to stretch extending from said reinforced eye to substantially the outer edge of said sections, said pole, reinforced eye and strips keeping the innermost corners and sides of the rectangular sections adjacent thereto relatively undeformed and linear while the outermost corners are stretched on the bias to stretch the outermost sides of the rectangular section so as deform the rectangular sections into a substantially offset diamond shape.

2. A shelter according to claim 1 wherein:

two pairs of adjacent corner sections are secured to opposite ends of a central section of a fabric which is stable on the bias.

3. A shelter according to any one of the preceding claims wherein:

there is secured to the periphery of the cover a strip of flexible material resistant to stretch.

* * * * *